US007042408B2

(12) United States Patent
Peng

(10) Patent No.: US 7,042,408 B2
(45) Date of Patent: May 9, 2006

(54) MOBILE PLANAR SATELLITE ANTENNA

(75) Inventor: Juen Tien Peng, Chung Li (TW)

(73) Assignee: Action Electronics Co., Ltd., Chung Li (TW)

( * ) Notice: Subject to any disclaimer, the term of this patent is extended or adjusted under 35 U.S.C. 154(b) by 0 days.

(21) Appl. No.: 10/894,010

(22) Filed: Jul. 20, 2004

(65) Prior Publication Data

US 2006/0017639 A1 Jan. 26, 2006

(51) Int. Cl.
*H01Q 1/32* (2006.01)

(52) U.S. Cl. ..... 343/713; 343/766

(58) Field of Classification Search ..... 343/713, 343/766, 711, 757, 788
See application file for complete search history.

(56) References Cited

U.S. PATENT DOCUMENTS 6,172,650 B1 * 1/2001 Ogawa et al. ..... 343/836
6,204,823 B1 * 3/2001 Spano et al. ..... 343/766
6,512,490 B1 * 1/2003 Lee ..... 343/882
6,577,281 B1 * 6/2003 Yamamoto et al. ..... 343/766
2004/0125035 A1 * 7/2004 Noro et al. ..... 343/711

* cited by examiner

*Primary Examiner*—Hoang V. Nguyen
(74) *Attorney, Agent, or Firm*—Rosenberg, Klein & Lee

(57) ABSTRACT

A mobile planar satellite includes a planar satellite signal receiving circuit assembly for receiving signal from an artificial satellite, a base provided with a bottom positioning member, a signal line extended from the planar satellite signal through the base for connection to a video output device, and a driving device provided between the base and the planar satellite signal receiving circuit assembly for moving the planar satellite signal receiving circuit assembly relative to the base and to change the signal receiving position of said planar satellite signal receiving circuit assembly relative to said base subject to the angle, azimuth, focusing and polarity of the satellite.

5 Claims, 5 Drawing Sheets

MOBILE PLANAR SATELLITE ANTENNA

BACKGROUND OF THE INVENTION

1. Field of the Invention

The present invention relates to a satellite antenna and more particularly, to a mobile planar satellite antenna that automatically traces the satellite.

2. Description of the Related Art

Following continuous development of the society, people do more care about product quality. For example, when watching a satellite TV program, we do care about the resolution of the picture and the quality of the output sound.

Further, we may install a disk antenna in the roof of the house or building to receive the signal of an artificial satellite. During installation, the angle and azimuth of the disk antenna must be adjusted subject to the angle and azimuth of the artificial satellite, and then a dB meter is used to check the signal, and then the position of the disk antenna is adjusted subject to the reading data of the dB meter. This adjustment procedure is complicated and takes much time. Further, a disk antenna for this purpose is heavy and expensive, not practical for use in a car.

SUMMARY OF THE INVENTION

The present invention has been accomplished under the circumstances in view. It is one object of the present invention to provide a mobile planar satellite antenna, which is highly movable and practical for use in a car. It is another object of the present invention to provide a mobile planar satellite antenna, which is compact and lightweight. It is still another object of the present invention to provide a mobile planar satellite antenna, which is inexpensive to manufacture. It is still anther object of the present invention to provide a mobile planar satellite antenna, which automatically traces the satellite when moving with a vehicle.

To achieve these and other objects of the present invention, the mobile planar satellite antenna comprises a planar satellite signal receiving circuit assembly adapted to receive signal from an artificial satellite; a base adapted to support the planar satellite signal receiving circuit assembly, the base having a bottom side fixedly provided with a positioning member and a top side; a signal line electrically connected to the planar satellite signal receiving circuit assembly and extended through the base for connection to an external video output device; and a driving device provided between the top side of the base and the planar satellite signal receiving circuit assembly and adapted to move the planar satellite signal receiving circuit assembly relative to the base and to change the signal receiving angle, azimuth, focusing and polarity of the planar satellite signal receiving circuit assembly subject to the direction and angle of the base relative to the satellite from which the planar satellite signal receiving circuit assembly is receiving a satellite signal. Further, the mobile planar satellite antenna may be used with a rack that comprises a jack for receiving the signal line, and a cable extended from the jack for connection to a video output device.

DETAILED DESCRIPTION OF THE PREFERRED EMBODIMENT

Figure 1:
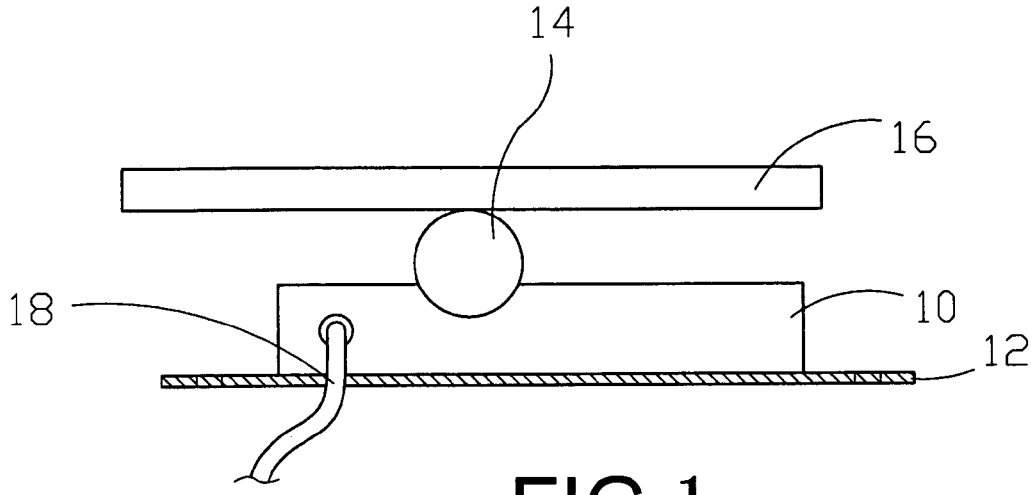
FIG. 1 is a schematic drawing showing a mobile planar satellite antenna according to the present invention.

Referring to FIG. 1, a mobile planar satellite antenna in accordance with the present invention is shown comprising a base 10, a positioning member 12 fixedly provided at the bottom side of the base 10 for positioning on a flat surface, a planar satellite signal receiving circuit assembly 16, a driving device 14 provided between the base 10 and the planar satellite signal receiving circuit assembly 16, and a signal line 18 connected to the planar satellite signal receiving circuit assembly 16 and extended out of one side of the base 10. In order to protect the mobile planar satellite antenna against EMI, the base 10 is internally covered with a layer of magnetic wave shielding material (not shown). The driving device 14 can be a motor. The signal line 18 is directly connected to a digital signal converter (not shown) that converts satellite signal received by the planar satellite signal receiving circuit assembly 16 into a video output device readable signal.

Figure 2:
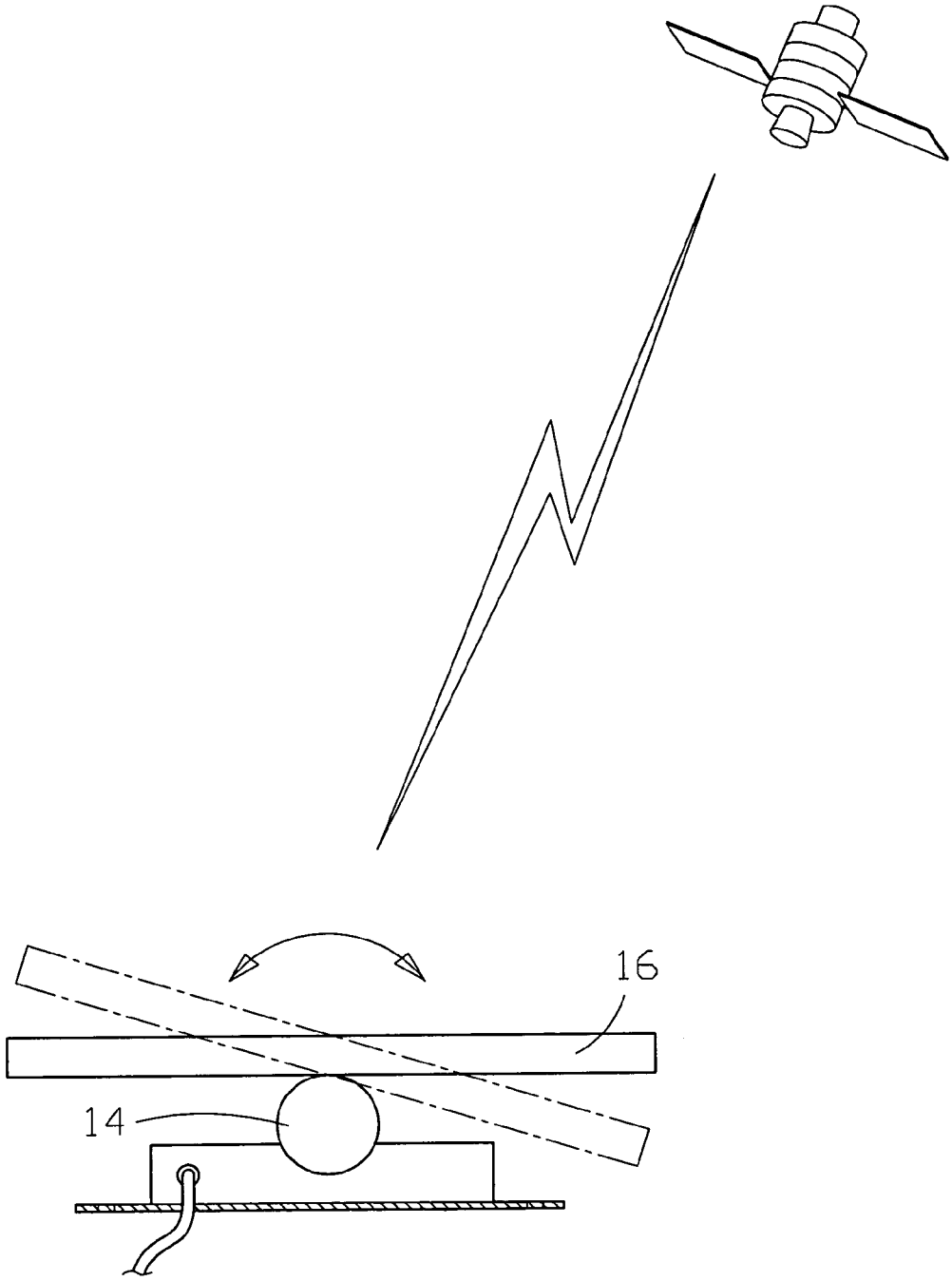
FIG. 2 is a schematic drawing of the present invention showing a position adjusting status of the mobile planar satellite signal receiving circuit assembly.

Referring to FIG. 2, when using the mobile planar satellite antenna to receive the satellite signal of an artificial satellite, the driving device 14 is controlled to move the planar satellite signal receiving circuit assembly 16, thereby changing the signal receiving position of the planar satellite signal receiving circuit assembly 16 relative to the base 10 subject to the angle, azimuth, focusing and polarity of the satellite.

Figure 3:
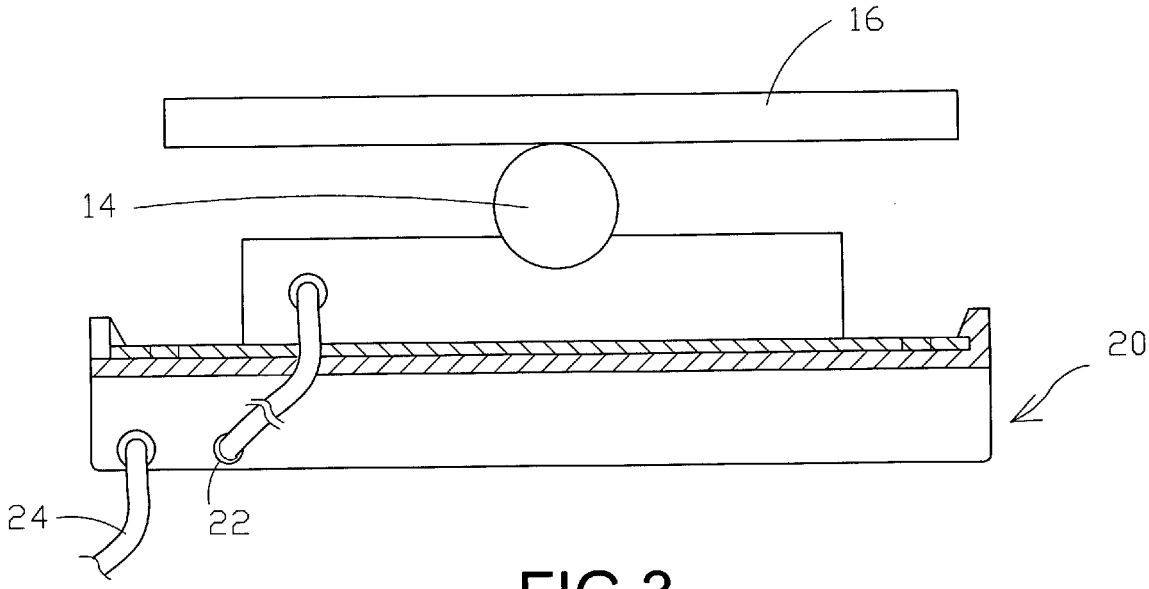
FIG. 3 is a schematic drawing showing the mobile planar satellite antenna used with a rack according to the present invention.
Figure 4:
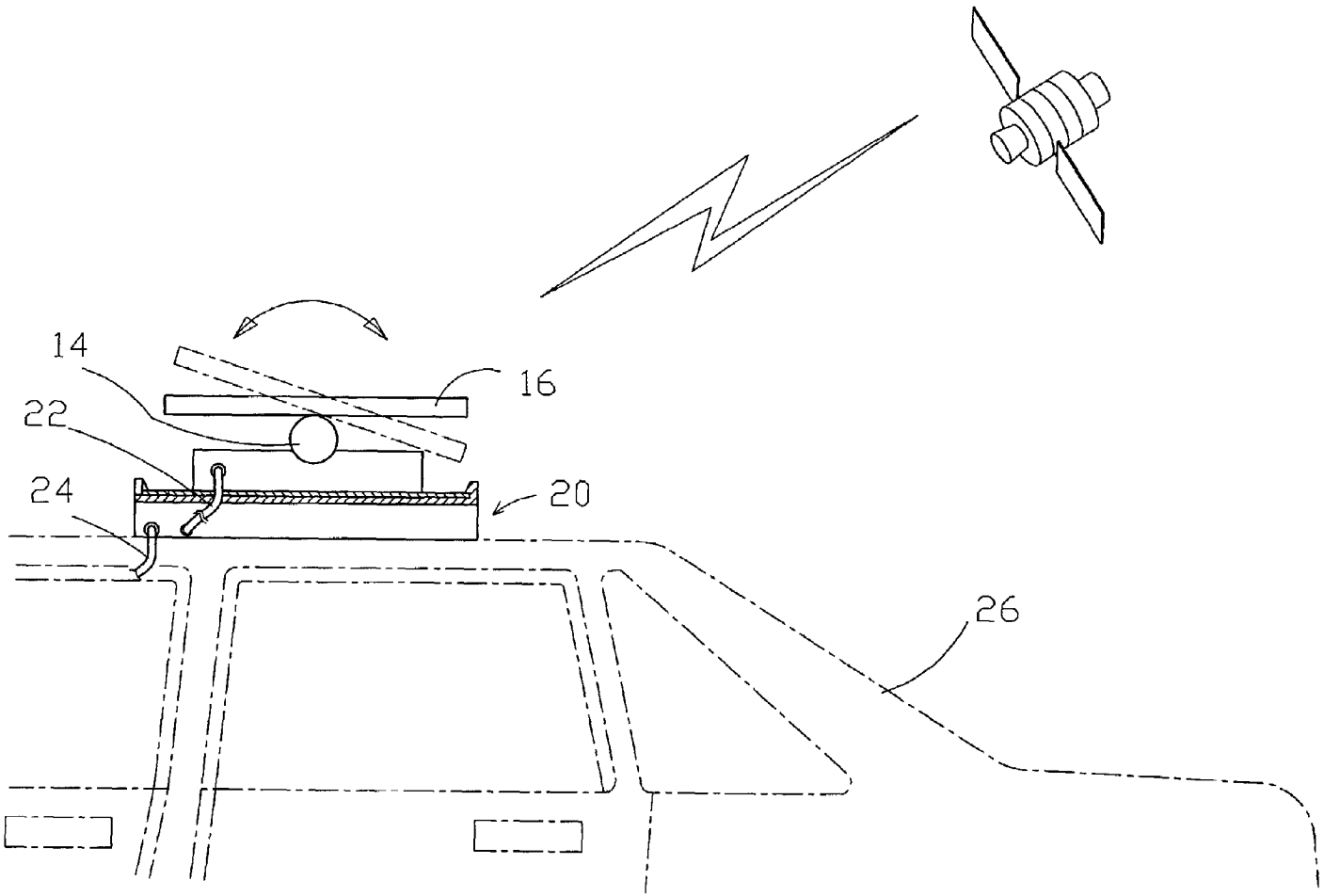
FIG. 4 is a schematic drawing showing the mobile planar satellite antenna mounted with a rack on the roof of a car according to the present invention.

Referring to FIGS. 3 and 4 and FIGS. 1 and 2 again, the mobile planar satellite antenna may be used with a rack 20. The rack 20 supports the positioning member 12 firmly in place, for example, on the roof of a car 26, having a signal input jack 22, which receives the signal line 18, and a cable 24 extended out of the signal input jack 22 and connected to the video output device, for example, LCD (not shown) inside the car 26.

Figure 5:
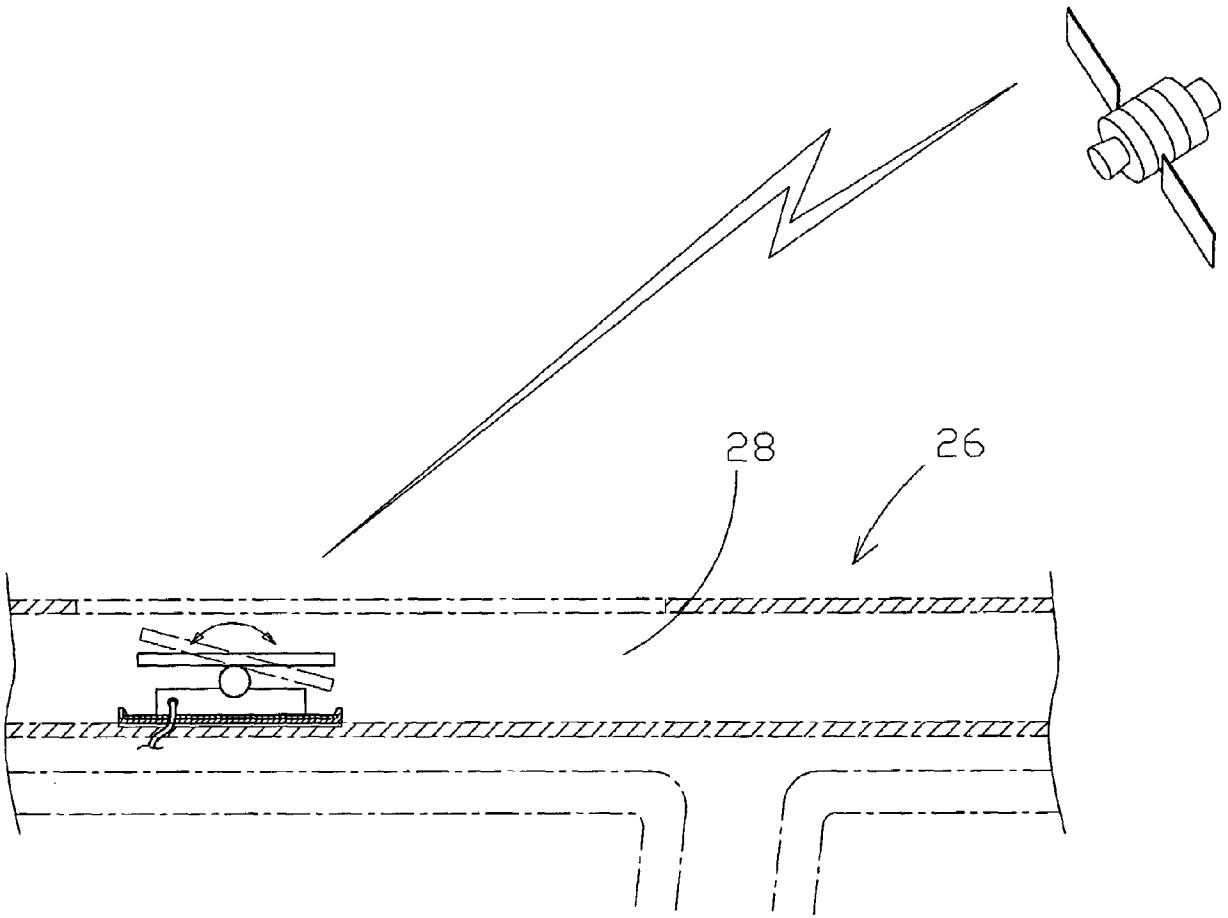
FIG. 5 is a schematic drawing showing the mobile planar satellite antenna mounted in a conceived compartment under the roof of a car according to the present invention.

Referring to FIG. 5 and FIGS. 1 and 2 again, the mobile planar satellite antenna may be installed in a conceived compartment 28 beneath the roof of the car 26. This installation example keeps the mobile planar satellite antenna from sight. When watching a satellite program, the driving device 14 is controlled to adjust the position of the planar satellite signal receiving circuit assembly 16 subject to the running direction of the car 26, enabling the planar satellite signal receiving circuit assembly 16 to receive the best status of the satellite signal.

As indicated above, the compact mobile planar satellite antenna has the advantage of high mobility. It can easily be fastened to the rack 20 and installed with the rack 20 in a car or any suitable place, keeping the signal line 18 of the mobile planar satellite antenna electrically connected to the signal input jack 22 of the rack 20 and the cable 24 of the rack 20 electrically connected to the video output device, for example, LCD of the car. Further, the rack 20 is preferably made of stainless steel material.

A prototype of mobile planar satellite antenna has been constructed with the features of FIGS. 1~5. The mobile planar satellite antenna functions smoothly to provide all of the features discussed earlier.

Although a particular embodiment of the invention has been described in detail for purposes of illustration, various modifications and enhancements may be made without departing from the spirit and scope of the invention.

What the invention claimed is:

1. A mobile planar satellite antenna comprising:

a planar satellite signal receiving circuit assembly adapted to receive signal from an artificial satellite;

a base adapted to support said planar satellite signal receiving circuit assembly, said base having a bottom side fixedly provided with a positioning member and a top side, said base being covered with a layer of magnetic wave shielding material;

a signal line electrically connected to said planar satellite signal receiving circuit assembly and extended through said base for connection to an external video output device; and a driving device provided between the top side of said base and said planar satellite signal receiving circuit assembly and adapted to move said planar satellite signal receiving circuit assembly relative to said base and to change the signal receiving position of said planar satellite signal receiving circuit assembly relative to said base subject to the angle, azimuth, focusing and polarity of the satellite from which said planar satellite signal receiving circuit assembly is receiving a satellite signal.

2. The mobile planar satellite antenna as claimed in claim 1, wherein said signal line is connectable to a signal converter that converts satellite signal into video output device readable signal.

3. The mobile planar satellite antenna as claimed in claim 1, wherein said driving device is a motor.

4. A mobile planar satellite antenna, comprising:

a planar satellite signal receiving circuit assembly adapted to receive signal from an artificial satellite;

a base adapted to support said planar satellite signal receiving circuit assembly, said base having a bottom side fixedly provided with a positioning member and a top side;

a signal line electrically connected to said planar satellite signal receiving circuit assembly and extended through said base;

a rack adapted to support said base on a vehicle, said rack comprising a jack adapted to receive said signal line and a cable extended from said jack for connection to an external video output device; and a driving device provided between the top side of said base and said planar satellite signal receiving circuit assembly and adapted to move said planar satellite signal receiving circuit assembly relative to said base and to change the signal receiving position of said planar satellite signal receiving circuit assembly relative to said base subject to the angle, azimuth, focusing and polarity of the satellite from which said planar satellite signal receiving circuit assembly is receiving a satellite signal.

5. The mobile planar satellite antenna as claimed in claim 4, wherein said rack is made of stainless steel.

* * * * *